US006279908B1

(12) United States Patent
Hunsberger

(10) Patent No.: US 6,279,908 B1
(45) **Date of Patent: *Aug. 28, 2001**

(54) DIABETES MELLITUS GAME

(76) Inventor: Glenn E. Hunsberger, 24 Spruce La., New Hyde Park, NY (US) 11040

( * ) Notice: Subject to any disclaimer, the term of this patent is extended or adjusted under 35 U.S.C. 154(b) by 0 days.

This patent is subject to a terminal disclaimer.

(21) Appl. No.: 09/039,184

(22) Filed: Mar. 16, 1998

(51) Int. Cl.[7] ..... A63F 9/18
(52) U.S. Cl. ..... 273/249; 273/431
(58) Field of Search ..... 273/242, 243, 273/248, 249, 429, 430, 431

(56) References Cited

U.S. PATENT DOCUMENTS

| | | | |
|---|---|---|---|
| 4,398,721 | | 8/1983 | McKay . |
| 4,984,805 | | 1/1991 | Medlock . |
| 4,986,757 | | 1/1991 | Mueller . |
| 5,062,645 | | 11/1991 | Goodman et al. . |
| 5,215,309 | | 6/1993 | Joel . |
| 5,228,860 | * | 7/1993 | Hale ..... 273/243 X |
| 5,316,308 | * | 5/1994 | Stembokas ..... 273/249 |
| 5,435,565 | * | 7/1995 | Benaderet ..... 273/243 |
| 5,474,295 | | 12/1995 | Demshuk . |
| 5,556,100 | * | 9/1996 | Taylor et al. ..... 273/249 |
| 5,704,611 | * | 1/1998 | Pierce ..... 273/243 |

FOREIGN PATENT DOCUMENTS

| | | |
|---|---|---|
| 2215222 | 9/1989 | (GB) . |
| 2229930 | 10/1990 | (GB) . |

* cited by examiner

*Primary Examiner*—Jeanette Chapman
(74) *Attorney, Agent, or Firm*—Richard C. Litman

(57) ABSTRACT

A diabetes mellitus game apparatus comprising a game board having a player path, player pieces, a chance determining means, and a plurality of sets of cards having a question, an answer, and a penalty, all relating to an aspect of diabetes mellitus, the penalty for an incorrect answer including requiring the player answering incorrectly to engage in a benign behavior simulating a symptom of diabetes at each successive turn in the game.

8 Claims, 3 Drawing Sheets

DIABETES MELLITUS GAME

BACKGROUND OF THE INVENTION

1. Field of the Invention

The present invention relates to a board game that is designed to convey instruction and information about the disease of diabetes mellitus as well as to provide entertainment. More specifically, the board game of the invention is designed to educate the players as to the relationship between the disease and diet, medications, side effects, etc., employing questions and answers and role playing simulation as a teaching technique.

2. Description of the Related Art

Board games have been developed for various educational purposes. Board games have been developed for educating adults concerning general nutrition (salt, sugar, cholesterol, etc.) information (U.S. Pat. No. 4,398,721 issued to McKay Aug. 16,1983) and exercise and diet (U.S. Pat. No. 5,062,645 issued to Goodman et al., Nov. 5, 1991). A nutrition and exercise game aimed a three to six year old children is described in U.S. Pat. No. 4,9863,757 issued to Mueller Jan. 22, 1991.

An educational game to teach general preventive heath care is described in U.S. Pat. No. 5,215,309 issued to Joel on Jan. 1, 1993. A board game to provide education on the risk of AIDS is described in U.K. Patent 2,215,222 issued Sep. 20, 1989 to McCorquodale, et al. A board game to test general knowledge is described in U.S. Pat. No. 4,984,805 issued Jan. 15, 1991 to Medlock. A board game to provide education on the meaning and spelling of words is described in U.K. Patent 2,229,930 issued to Bescoby. A motorized spinner with switches capable of being operated by various body parts to make board games accessible to the handicapped is described in U.S. Pat. No. 5,474,295 issued Dec. 12, 1995 to Demshuk.

None of the foregoing inventions is seen to provide education on the diet of the diabetic, medications for the diabetic, side effects, and various other aspects of the disease. None of the foregoing inventions is seen to incorporate role playing or simulation of the various aspects of a disease into the format of a board game as a method of reinforcing the teachings on the disease.

None of the above inventions and patents, taken either singularly or in combination, is seen to describe the instant invention as claimed. Thus a diabetes mellitus game solving the aforementioned problems is desired.

SUMMARY OF THE INVENTION

Diabetes mellitus is a serious health problem afflicting 2% to 4% of the population, with similar percentages of the population having abnormal glucose tolerance. Sadly, most people do not become educated to the effects of the disease and its impact on the life style of the diabetic until they or someone in their family become afflicted with the disease.

As shown in the prior art, educational games traditionally rely solely on the player's verbal memory skills to educate the player about health issues.

The present invention describes a board game having a plurality of sequentially marked spaces, with a chance determining means such as a die or spinner to control the rate at which a player's piece traverses the board. The majority of spaces have a means, preferably color coding, associating the space with a class of questions relating to diabetes. As a player's piece lands on particular spaces, the player must respond to questions regarding various aspects of the disease diabetes mellitus, such as diet, medications, signs, symptoms and side effects of the disease. Failure to answer the question correctly results in assessment of a penalty, requiring the player to engage in a benign activity simulating a side effect of the disease, such as being required to walk to the bathroom and close the door to simulate polyurea. The penalty must be repeated before each succeeding turn, hence it may have to be repeated many times in the course of one game. The repetition of role playing behavior is used as a device to reinforce teachings concerning the disease and further impress information concerning the disease in the player's memory.

Accordingly, it is a principal object of the invention to provide an apparatus comprising a game board, player pieces, a chance determining means, and question and answer cards conveying information about diabetes mellitus in order to educate and disseminate information concerning the disease.

It is another object of the invention to provide a method of using the apparatus to improve education concerning the disease by incorporating role playing and simulation of the various aspects of a disease into the format of a board game.

It is a further object of the invention to provide a method of providing education and information concerning the disease of diabetes which also provides entertainment.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to teaching information about the disease of diabetes mellitus through use of an entertaining game board apparatus.

Figure 1:
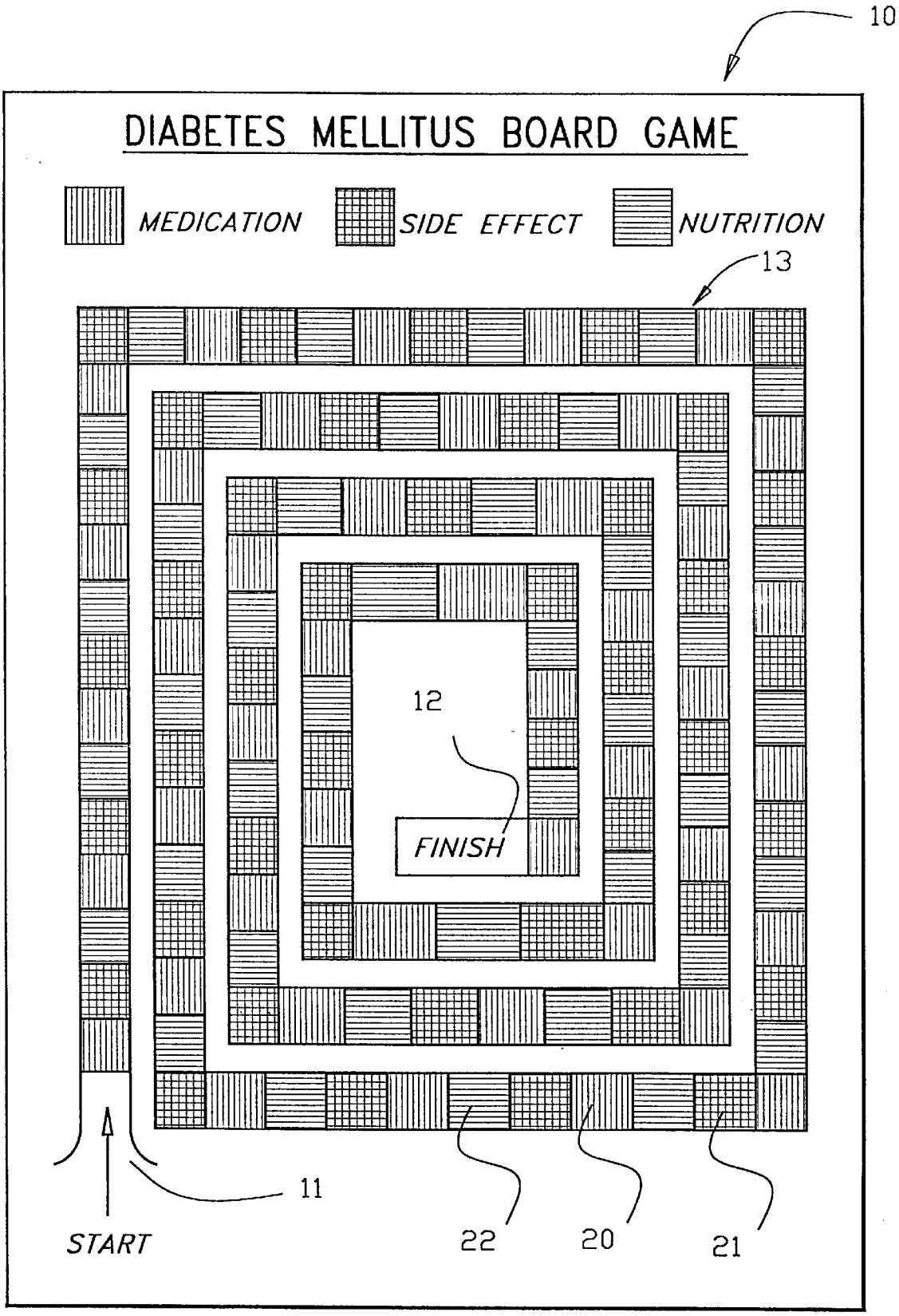
FIG. 1 is a plan view of a diabetes mellitus game card according to the present invention, showing the start area, the finish area, and the playing path.

The apparatus comprises a game board 10 as shown in FIG. 1. The game board 10 has a start area 11, a finish area 12, and a plurality of sequentially delimited spaces between the start area 11 and the finish area 12 which define a playing path 13. The sequentially delimited spaces are color coded. In the embodiment shown in FIG. 1, the spaces alternate between red spaces 20, yellow spaces 21, and blue spaces 22.

Figure 2:
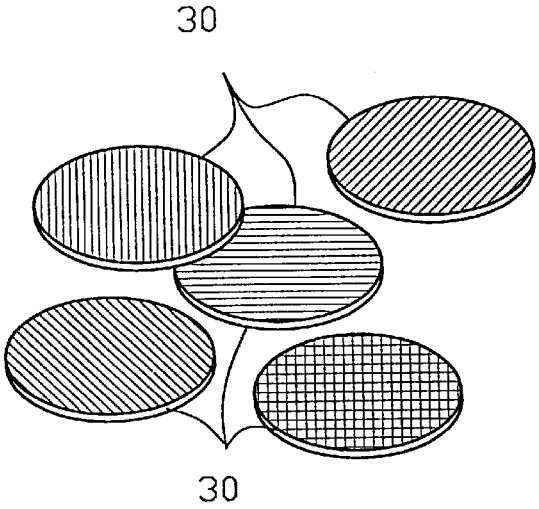
FIG. 2 is a top perspective view of the player tokens for marking the player's progress on the playing path of the game board.
Figure 3:
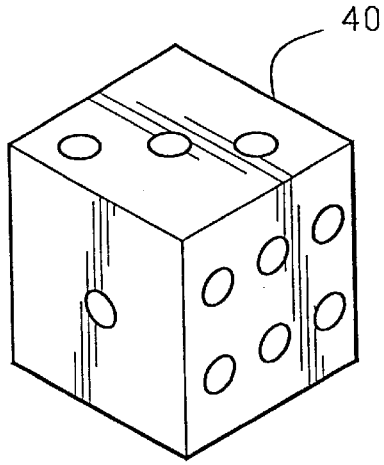
FIG. 3 is a front perspective view of the chance determining means (a die) in one embodiment of the present invention.
Figure 4:
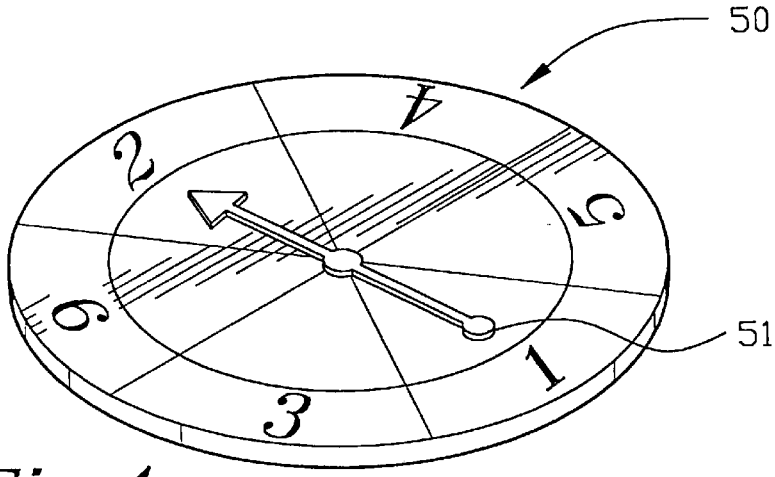
FIG. 4 is a top perspective view of the chance determining means (a spinner) is a second embodiment of the present invention.

The apparatus includes a plurality of player tokens 30 as shown in FIG. 2. The tokens 30 may be simple flat circular chips of varying colors (red, blue, green, brown and yellow) as shown or any other shape, design or color, provided the tokens may be distinguished from each other. The apparatus also includes a chance determining means, either a die 40 as shown in FIG. 3, or a spinner 50, as shown in FIG. 4.

Figure 5:
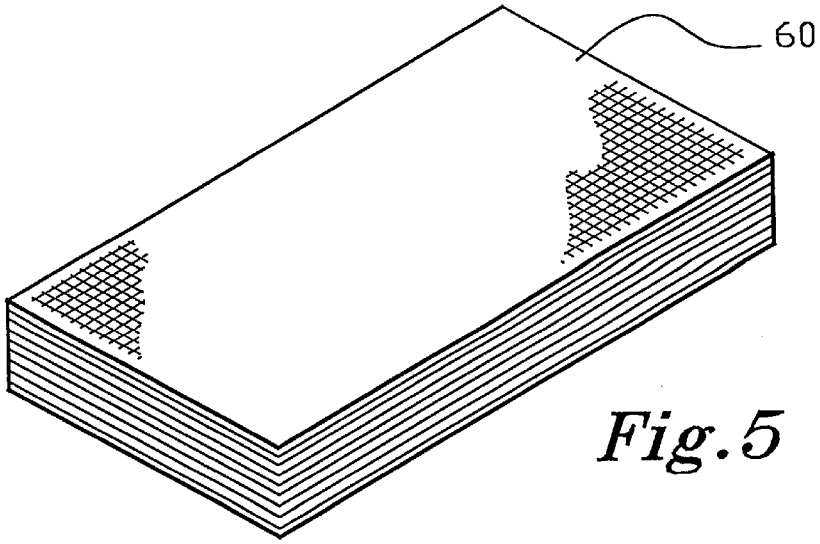
FIG. 5 is a perspective view of a set of cards having questions, answers and penalties imprinted thereon.
Figure 6:
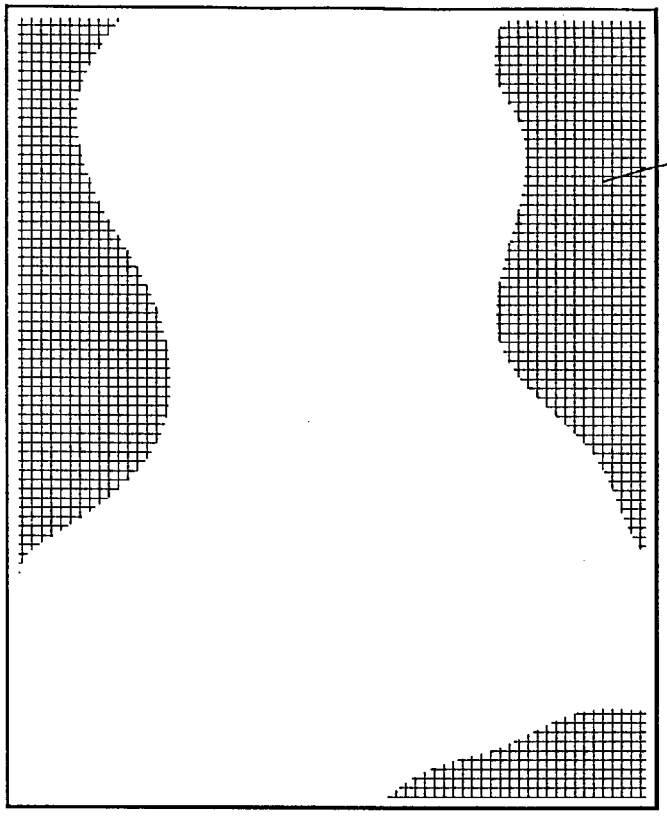
FIG. 6 is a plan view of an exemplary question, answer and penalty card.
Figure 7:
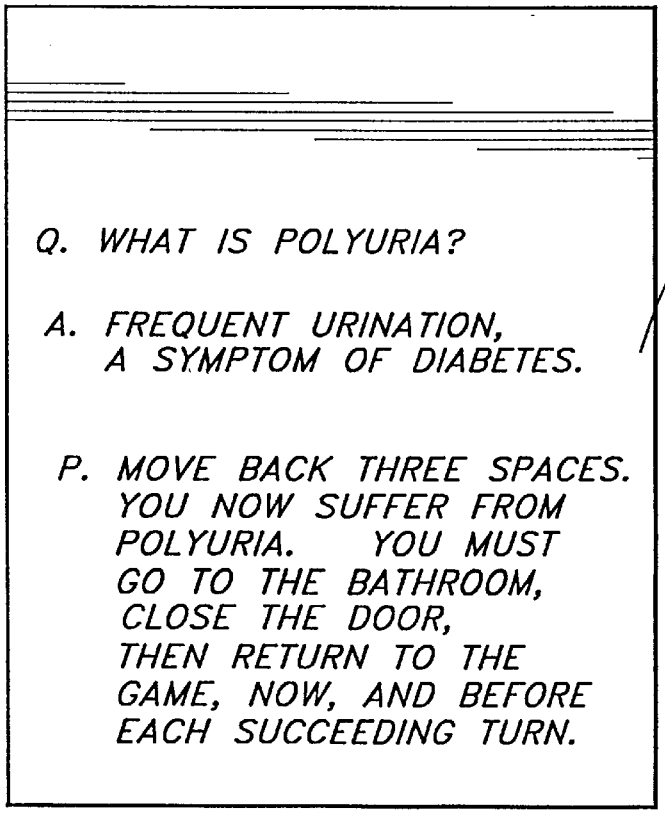
FIG. 7 is a bottom view of the same card shown in FIG. 6.

The apparatus has means associated with each space for associating the space with a set of question and answer pairs. In a preferred embodiment, the apparatus has a plurality of sets of cards 60, one of which is shown in FIG. 5. An exemplary card 61 is shown in FIGS. 6 and 7. Each card 61 has a means for associating the card with a particular set on the top side 61*a*. The means shown in FIG. 6 is simple color coding, the top side being yellow. Other sets may have red tops or blue tops. The bottom side 61*b* of the card has imprinted thereon a question and correct answer relating to some aspect of diabetes and a penalty for an incorrect answer, as shown in FIG. 7. The card shown in FIG. 7 asks the question "What is polyurea?" and the answer shown is "Frequent urination, a symptom of diabetes". The penalty for an incorrect answer to this question as shown on the card in FIG. 7 is "Move back three spaces. You now suffer from polyurea. You must go to the bathroom, close the door, then return to the game now and before each succeeding turn."

Each question and answer pair on all the cards in an individual set relate to the same aspect of diabetes. The means shown on the card for associating the card with a set 61*a* corresponds to a means shown on each sequentially delimited space on the game board 10. For example, a yellow sequentially delimited space 21 corresponds to a set of cards having a yellow top 60. The red set of cards corresponds to a category of questions relating to diabetes and medications. Similarly, the yellow set corresponds to a category of questions concerning diabetes and its side effects, while the blue set corresponds to questions relating to diabetes and nutrition.

The method of using the apparatus to teach information about diabetes mellitus is as follows. The players select a token 30 and place the token in the start area 11 of the game board 10. Any conventional means may be used to select the order of play. In the preferred embodiment, each player rolls the die 40 (or in an alternative embodiment, spins the pointer 51 on the spinner 50), the order of play going from the highest number rolled to the lowest number. If two players roll the same number, those two players continue to roll the die 40 until they roll different numbers to determine which of the two goes first.

The player whose turn it is rolls the die 40 and advances his token 30 along the playing path 13 according to the number of pips on the die 40. The space on which his token 30 now rests is color coded either red 20, corresponding to questions about medications and diabetes, yellow 21, corresponding to questions about the side effects of diabetes, or blue 22, corresponding to questions about nutrition and diabetes. An opposing player selects a card from the corresponding set of cards 60 and asks the question on the bottom of the card 61*b*. If the player responds with the correct answer, he continues his turn by rolling the die 40, advancing his token 30 on the playing path 13, and answering questions until he gives an incorrect answer.

If the player answers the question incorrectly, he must perform the penalty given on the bottom side of the card 61*b*. The penalties consist of a combination of moving the player's token 30 backwards on the playing path 13 towards the start area 11 a given number of spaces, and performing a benign behavior simulating a side effect of diabetes. Exemplary penalties are:

Polyuria (frequent urination)—The player is required to walk to the bathroom and close the door, then return back to the game.

Retinopathy (visual disability)—A sun glass type eye covering is worn where additional lenses may be flipped over the eyes to simulate increasing visual disability.

Polvdipsia (insatiable thirst)—The player is directed to drink a quantity of water.

Hunger—The player may eat no food during the game.

Irritability—The player is only allowed to say "yes" or "no" during the game except when answering questions during his turn.

Headache—Other players are not allowed to speak to this player and all sound devices (TV, radio) must be turned off.

Weakness/fatigue—The player's movements require the assistance of another player. If he must leave the game area, another player must accompany him.

Finger stick/glucose test—A rubber band is placed around the player's wrist. It is pulled away from the wrist and let go quickly, snapping back and causing a slight sting simulating a needle breaking the skin in the glucose test.

Neuropathy—A player will be restricted from moving a specified limb during play of the game.

The penalty is performed immediately. The player loses his turn and he must perform side effect again before rolling the die 40 at his next succeeding turn for the duration of the game, i.e., he has the side effect for the duration of the game. Penalty behaviors may accumulate and combine. For example, if a player incurs polyurea as a penalty and subsequently incurs weakness as a penalty, he must have another player accompany him to the bathroom where he must close the door before returning to the game. The repetitive nature of simulating the side effects of diabetes has the effect of inculcating an additional memory trigger in the player, so that when he hears diabetes mentioned again, he may, for example, remember having to go to the bathroom and close the door twenty or thirty times in the course of playing the diabetes mellitus game, thereby remembering polyuria as a symptom of diabetes, and perhaps also the particular questions and answers of the game.

The game ends with the first player to advance his token 30 to the finish area 12.

It will be apparent to those skilled in the art of designing board games that the means for associating a sequentially delimited space with a set of question and answer pair is not limited to a set of cards. For example, in another embodiment, the space may have a penalty and a reference imprinted on the space, said reference being to a page or section of a question and answer booklet either packaged with the game or published by an authoritative organization, such as the American Diabetes Association, with the question and answer pair to be selected at random from said page or section.

It will also be apparent to those skilled in the art of designing board games that the means for associating a particular delimited space in the playing path 13 with a set of cards 60 is not restricted to color coding. In another embodiment the category of question, for example, nutrition, might be printed both on the space on the board 10 and on the top of the card 61*a*.

It will further be apparent to those skilled in the art that the method of teaching by associating role playing or simulation of the side effects of a disease with a board game having a question and answer format is not restricted to diabetes mellitus, but may be applied to other diseases such as heart disease, lung disease, or the like. For example, the cards may be altered to ask questions about an aspect of heart disease, such as "What is angina pectoris?", answer "Chest pain, particularly on exercise", penalty "You have angina. You must stand up, walk three paces, and clutch your chest for 10 seconds to simulate chest pain now and at each succeeding turn" or "You must simulate taking nitroglycerin sublingually for chest pain. Place a thimble full of water under your tongue and hold it there for 30 seconds without swallowing." The game can be made to teach about medical diseases generally by having each set of question and answer pairs deal with a different disease, the penalty for an incorrect answer being simulation of an aspect of the particular disease to which the question relates. For purposes herein, the phrase "aspects of the disease" includes, but is not limited to, the signs, symptoms, pathology, physiology, nutrition, resultant effects, medications, treatments, side effects, etc. of a disease as is or may become known in the medical and research sciences.

In the embodiment shown in FIG. 1, the player path 13 shows an alternating pattern of three sets of questions. It will also be apparent to those skilled in the art of board games that the game board may optionally include additional sets of questions, for example, statistical information on diabetes, or it may optionally include free spaces not linked to a question and answer pair, or bonus or penalty spaces for repositioning the player's token 30 forwards or backwards on the playing path 13 without answering a question and answer pair.

It is to be understood that the present invention is not limited to the embodiments described above, but encompasses any and all embodiments within the scope of the following claims.

I claim:

1. A game apparatus for a diabetes mellitus game to be played by a plurality of players, comprising:

(a) a game board having a start area, an end area, and a plurality of sequentially delimited spaces therebetween defining a playing path;

(b) a plurality of playing pieces, one for each player, for traversing the playing path of said game board;

(c) a chance determining means for indicating a number of said sequentially delimited spaces in said playing path to be traversed by that player's said playing piece in one turn;

(d) means associated with said plurality of sequentially delimited spaces for identifying each respectively with a set, wherein each said set consists of a category of question and correct answer pairs, wherein further each of said plurality of said question and answer pairs relates to the same aspect of diabetes mellitus as said category; and wherein further a penalty is associated with at least one said question and answer pair for an incorrect answer given, said penalty consisting of an instruction to engage in a benign behavior simulating an aspect of diabetes mellitus.

2. A game apparatus according to claim 1 wherein said chance determining means comprises a die.

3. A game apparatus according to claim 1 wherein said chance determining means comprises a spinner having a plurality of integers randomly distributed around the periphery.

4. A game apparatus according to claim 1, wherein said penalty further comprises an instruction to the player to move his playing piece a specified number of said sequentially delimited spaces.

5. A game apparatus according to claim 1, further comprising:

(a) a plurality of cards, each said card having imprinted thereon a question, a corresponding correct answer, a penalty, and means for identifying the card with said set;

(b) wherein said means for identifying said card with said set comprises color coding; and (b) wherein said means associated with said sequentially delimited spaces comprises color coding.

6. A method of teaching about diabetes mellitus to a plurality of players using the board game apparatus according to claim 5, comprising the steps of:

(a) positioning a marker token for each player at the start area of said game board;

(b) selecting an order of play;

(c) advancing the token of the player whose turn is current a number of said sequentially delimited spaces determined by said chance determining means towards said finish area;

(d) selecting a said card from said set of cards identified by means associated with said sequentially delimited space and said set respectively;

(e) posing the question on said card concerning an aspect of diabetes mellitus to said player;

(f) continuing said player's turn in the event of a correct answer, or alternatively assessing said player the corresponding penalty set forth on said card, wherein the penalty consists of positioning said player's token rearwardly towards said start area, requiring said player to engage in a benign behavior simulating an aspect of diabetes mellitus and to repeat said behavior prior to each succeeding turn, and terminating said player's turn;

(g) successively repeating said steps of advancing said player tokens, posing questions, and repositioning said player tokens until one of said player tokens is repositioned in said finish area.

7. A game apparatus for a medical disease game to be played by a plurality of players, comprising:

(a) a game board having a start area, an end area, and a plurality of sequentially delimited spaces therebetween defining a playing path;

(b) a plurality of playing pieces, one for each player, for traversing the playing path of said game board;

(c) a chance determining means for indicating a number of said sequentially delimited spaces in said playing path to be traversed by that player's said playing piece in one turn;

(d) means associated with said plurality of sequentially delimited spaces for identifying each respectively with a set, wherein each said set consists of a category of question and correct answer pairs, at least one said pair associated with a penalty for an incorrect answer, each said set comprising a plurality of said question and answer pairs relating to the same aspect of the medical disease; and (e) wherein said penalty consists of an instruction to the player to move his playing piece a specified number of said sequentially delimited spaces and an instruction to the player to engage in a benign behavior simulating an aspect of said medical disease.

8. A method of teaching about medical disease to a plurality of players using the board game apparatus according to claim 7, comprising the steps of:

(a) positioning a marker token for each player at the start area of said game board;

(b) selecting an order of play;

(c) advancing the token of the player whose turn is current a number of said sequentially delimited spaces determined by said chance determining means towards said finish area;

(d) selecting a said question and answer pair from said set of question and answer pairs identified by means associated with said sequentially delimited space and said set respectively;

(e) posing the question of said question and answer pair concerning an aspect of the medical disease to said player;

(f) continuing said player's turn in the event of a correct answer, or alternatively assessing said player the corresponding penalty set forth on said card, wherein the penalty consists of positioning said player's token rearwardly towards said start area, requiring said player to engage in a benign behavior simulating an aspect of said medical disease and to repeat said behavior prior to each succeeding turn, and terminating said player's turn;

(g) successively repeating said steps of advancing said player tokens, posing questions, and repositioning said player tokens until one of said player tokens is repositioned in said finish area.

* * * * *